United States Patent [19]

Chang

[11] Patent Number: 4,791,703

[45] Date of Patent: Dec. 20, 1988

[54] LENGTH ADJUSTABLE CENTER ROD STRUCTURE FOR A VERTICAL SHUTTER DRAPE

[76] Inventor: A-Shen Chang, No. 15, Lane 494, Fu Chien Rd., Fu Hsing Ts'un, Fu Hsing Hsiang, Changhua Hsien, Taiwan

[21] Appl. No.: 71,546

[22] Filed: Jul. 7, 1987

[51] Int. Cl.[4] ..... A47H 1/022

[52] U.S. Cl. ..... 16/94 D; 16/95 D; 16/96 D; 16/87 R; 160/166.1; 160/176.1; 160/178.1

[58] Field of Search ..... 16/87 R, 94 R, 94 D, 16/96 R, 96 D, 93 R, 93 D, 95 D; 160/168 R, 176 R, 166 A, 178 R, 177 A

[56] References Cited

U.S. PATENT DOCUMENTS 4,699,196 10/1987 Elliott ..... 160/168 R

*Primary Examiner*—Nicholas P. Godici
*Assistant Examiner*—Edward A. Brown
*Attorney, Agent, or Firm*—Browdy and Neimark

[57] ABSTRACT

The present invention relates to a length adjustable center rod structure for a vertical shutter drape. The center rod is located in the inner side of an over-head track, and has two or more sections of telescoped hollow tubes so that the length thereof can be easily adjusted for length variations of the over-head track. The positioning of each hollow tube for the telescoping, is guided by a respective quasi-U-shaped, latitudinal, and straight trough provided on the tube wall. Each trough is also utilized for the reception of a downwardly protruding quasi-U-shaped tongue located on the sleeve axle inner surface sliding elements. When the center rod is rotated, it drives every shutter blade axle of the sliding elements to rotate via their respective sleeve axles.

4 Claims, 1 Drawing Sheet

LENGTH ADJUSTABLE CENTER ROD STRUCTURE FOR A VERTICAL SHUTTER DRAPE

SUMMARY OF THE INVENTION

The present invention relates to a center rod for a vertical shutter drape, which is housed within an over-head track, which comprises two or more sections of telescoped hollow tubes, whereby its length can be easily adjusted to cope with the length variation of an over-head track.

The structural components of a vertical shutter drape comprise mainly an over-head track which supports all the components of the drape, a center rod which is mounted on the inner side of the over-head track, the center being utilized to drive the shutter blade axles of the sliding elements to rotate (the shutter blades are vertically clamped by respective shutter blade axles at their top end so that they can rotate together with the shutter blade axles), and a pulling cord which is used to distribute out or to gather up the sliding elements. Since the vertical shutter drapes are produced with several specific sizes, such as 3 feet or 3½ feet, but in practice, they are not all suitably fitted, the frequently encountered problem is that the overhead track is longer than the mounting length. Of course an excessive length of the over-head track can be cut off, but a short one cannot be compensated. Therefore in the usual case one can only remove the extra length to meet the practical need. Since the sliding elements are removable components, such an excess length is able to be cut off from the over-head track, with the unneeded sliding elements being easily removed from the whole assembly so as to fit the practical requirement. If only a short extra length is cut off therefrom, no sliding elements need moved at all.

The traditinal center rod is a simple rigid rod which is manufactured by a drawing method and cut into a specific fixed length to match the specific drape assembly, when the over-head track is cut into proper size for practical need. The center rod is a thin rod made either of plastic or metal materials (ordinarily it is aluminium). While it can be cut off even if it is not easily cuttable, permanent stress deformation may arise due to poor workmanship, which can effect the movement and the adjustment of the sliding elements. In addition, since the center rod is located in the inner side of the over-head track, it cannot be cut off in-place without taking it out thereof.

The main object of the present invention is to provide an adjustable center rod structure for a vertical shutter drape, in which the length of the center rod can be easily adjusted to a required length via its telescopic structure.

The invention itself, however, both as to its construction and its method of operation, together with adddi-tional objects and features thereof, will be best understood from the following description of an embodiment, when read in connection with the accompanying drawings.

DESCRIPTION OF THE DRAWINGS

FIGS. 1, 1A and 1B are persepctive views of the structure of an example embodiment of the present invention. Namely:

Figures 1, 2:
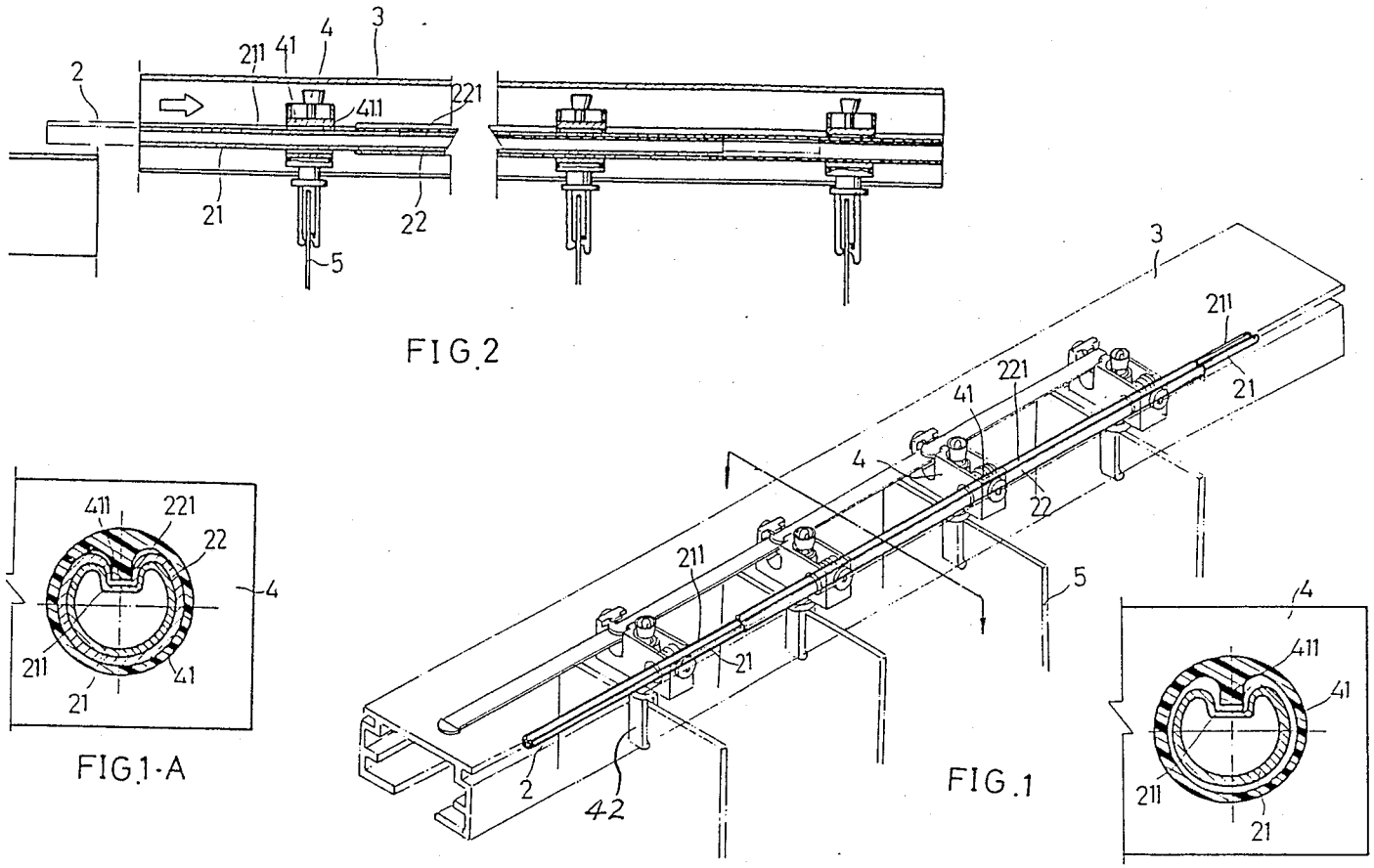

the illstrative sectional view of FIG. 1A shows how both of the inner and outer tubes of the telescopic center rod is engage in the sleeve axle of a sliding element; and the illustrataive sectional view of FIG. 1B shows how the inner tube of the telescopic center rod engages the sleeve axle of the sliding element.

FIG. 2 is an illustrative sectional view along the latitudinal axis of the center rod of the present invention.

DESCRIPTION OF THE PREFERRED EMBODIMENTS

Referring first to FIG. 1, the center rod 2 is located in the inner side of an over-head track, and is utilized to hang and support the sliding elements 4 by passing through their respective sleeve axles 41, in such a manner that the sliding elements 4 not only can be driven to move along the center rod 2, but further so that the shutter blades 5 which are attached on their respective shutter blade axles 42 of the sliding elements 4 can also be driven to rotate by the center rod 2.

The center rod 2 of the present invention comprises an outer tube 22 and an inner tube 21 that are telescoped together to form an adjustable center rod 2. In this embodiment, both the outer tube 22 and the inner tube 21 are provided along the full length of each tube with a straight downwardly extended quasi-U-shaped trough 211 and 221, so that the inner tube 21 can be telescoped into the outer tube 22 via the positioning and guidance of these U-shaped troughs 211 and 221, and so that these quasi-U-shaped troughs 211 and 221 can also be matched and engaged with the downwardly protruded quasi-U-shaped tongue 411 on the inner surface of the sleeve axle 41 of the sliding element 4 when the respective sliding elements 4 are attached on the center rod 2 via their respective sleeve axles 41. Furthermore, compensation for tub wall thickness differences between the inner tube 21 and the outer tube 22 are taken into consideration during the design of the U-shaped troughs 211, 221 and the U-shaped tongue 411, so that both of the U-shaped troughs 211 and 221 can drive the U-shaped tongue 411 of the sleeve axle 41 to rotate as indicated in FIGS. 1A and 1B.

Since the center rod 2 is made of a telescoped inner tube 21 and an outer tube 22, therefore, when the over-head track is cut off to meet a practical need, the only thing that needs to be done with center rod 2 is to adjust it to a required length, through a pulling out or pushing in of the tubes; and that can be easily performed by any person. In order to prevent the inner tube 21 from becoming too loosely fit to the outer tube 22 when they are telescoped outward, these tubes are formed to telescope comparatively tightly.

For an embodiment of a center rod 2 having telescoped hollow tubes with a total of more than two sections, when taking the tube wall thickness into consideration, it may be that certain sections are not suitable for multiple telescopic connection but this problem can be solved by telescoping out, from each end of a central tube section, an inner tube section as shown in FIG. 1. Here two inner tubes 21 telescope out from the two respective ends of an outer tube 22.

As a summary to the above description, though the present invention utilizes a traditional art, never the less it is a practical and novel creation, and it breaks through the limitations of the application of a traditional skill. Especially a lot of time and labour is saved in on-site installation of the present vertical shutter drape.

What I claim is:

1. A structure for supporting vertical shutter blades from an over-head track, comprising a center rod located in said over-head track, said center rod comprising at least one inner hollow tube and an outer hollow tube telescoped together with each said inner hollow tube extending inside said outer hollow tube, wherein a straight quasi-U-shaped trough is provided along each said hollow tube, and said U-shaped troughs cause the telescoped hollow tubes to rotate integrally as said center rod, a plurality of sliding elements, each said sliding element having a rotatable sleeve axle with a respective quasi-U-shaped tongue on an inner side of its sleeve axle, each said sliding element being attached on said center rod by engaging its respective quasi-U-shaped tongue in the quasi-U-shaped trough of a respective one of said telescoping hollow tubes of said center rod, each said sliding element having a shutter blade axle for supporting a respective one of said vertical shutter blades, wherein said shutter blade axle of each said sliding element rotates when its sleeve axle is rotated, wherein said sliding elements can move freely along said center rod, and said shutter blade axles of said sliding elements can be driven to rotate by rotating said center rod.

2. The structure of claim 1, wherein said center rod comprises two of said inner hollow tubes respectively telescoping at both ends of said outer hollow tube, with said inner hollow tubes fitting into said outer hollow tube, wherein stability of said center rod is provided during rotation thereof and sliding of said sliding elements thereon.

3. The structure of claim 1, further comprising said over-head track and said shutter blades.

4. The structure of claim 1, wherein said quasi-U-shaped tongues are all the same, and each said quasi-U-shaped tongue is rotatably driven by the quasi-U-shaped trough of the one of said hollow tubes on which the respective sliding element is located.

* * * * *